United States Patent [19]

Jungerwirth

[11] 4,323,237

[45] Apr. 6, 1982

[54] ADAPTIVE EXERCISE APPARATUS

[75] Inventor: Bernard R. Jungerwirth, Rego Park, N.Y.

[73] Assignee: Coats and Clark, Inc., Stamford, Conn.

[21] Appl. No.: 71,057

[22] Filed: Aug. 30, 1979

[51] Int. Cl.[3] ..... A63B 21/24

[52] U.S. Cl. ..... 272/131; 73/379

[58] Field of Search ..... 272/69, 93, 128, 129, 272/130, 131, 132, 133, 134, 143, DIG. 3, DIG. 5, DIG. 6; 73/379; 128/707; 434/247, 258

[56] References Cited

U.S. PATENT DOCUMENTS

| | | | |
|---|---|---|---|
| 3,364,736 | 1/1968 | Bathurst et al. | 73/134 |
| 3,395,698 | 8/1968 | Morehouse | 128/707 |
| 3,419,732 | 12/1968 | Lane | 272/93 X |
| 3,465,592 | 9/1969 | Perrine | 73/379 |
| 3,518,985 | 7/1970 | Quinton | 73/379 X |
| 3,543,724 | 12/1970 | Kirkpatrick et al. | 73/379 X |
| 3,572,700 | 3/1971 | Mastropaolo | 272/129 |
| 3,675,640 | 7/1972 | Gatts | 73/379 X |
| 3,744,480 | 7/1973 | Gause et al. | 128/707 |
| 3,802,698 | 4/1974 | Burian et al. | 128/707 |
| 3,845,756 | 11/1974 | Olsson | 128/707 |
| 3,848,467 | 11/1974 | Flavell | 73/379 |
| 3,869,121 | 3/1975 | Flavell | 272/DIG. 6 X |
| 3,929,331 | 12/1975 | Beeding | 272/132 |
| 3,953,025 | 4/1976 | Mazman | 272/132 |
| 3,984,666 | 10/1976 | Barron | 73/379 X |
| 3,989,240 | 11/1976 | Victor et al. | 272/134 X |
| 4,099,713 | 7/1978 | Spector | 272/93 |
| 4,112,928 | 9/1978 | Putsch | 128/707 |
| 4,184,678 | 1/1980 | Flavell et al. | 272/129 |

*Primary Examiner*—William H. Grieb

*Attorney, Agent, or Firm*—Burgess, Ryan and Wayne

[57] ABSTRACT

An adaptive exercise apparatus which provides a variable load against which a person may exercise, monitors the performance of the person against the load by measuring the work done in a predetermined time interval, and increments to a slightly greater value when the monitored performance level reaches a desired performance objective. Instead of increasing the load when a performance objective is met, the individual may be required to work at a greater rate by maintaining the load constant, and (i) either decreasing the time within which the work is to be performed, (ii) increasing the number of exercise cycles to be completed in the same time interval, or (iii) increasing the stroke or length associated with the particular exercise being performed.

13 Claims, 6 Drawing Figures

ADAPTIVE EXERCISE APPARATUS

This application relates to exercise apparatus, and more particularly to apparatus for training an individual by causing him to work progressively harder.

Exercise equipment which is preprogrammed to provide a desired exercise profile is well known in the art. See for example, U.S. Pat. Nos. 3,395,698 to Morehouse; 3,465,592 to Perrine; 3,518,985 to Quinton; 3,675,640 to Gatts; 3,802,698 to Burian et al.; 4,112,928 to Putsch; 3,364,736 to Bathurst et al.; 3,543,724 to Kirkpatrick et al; 3,572,700 to Mastropaolo; and also Nos. 3,744,480; 3,845,756; 3,848,467 and 3,984,666. Also of interest is an article in July, 1978 edition of Popular Science, page 84, which appears to describe an arrangement similar to that of Putsch.

Morehouse discloses an exercise system which provides a variable work load to the user. Physiological parameters of the user are measured and used to control the work load. In addition, heartbeat is continuously monitored and the whole system shuts down when a danger signal appears.

Perrine discloses an exercise apparatus in which the speed or amount of exercise is allowed to accelerate freely until it reaches a predetermined rate after which load is automatically applied to inhibit any further acceleration.

Quinton teaches an exercise apparatus in which the work load is controlled responsive to heart rate and heart rate acceleration.

Gatts discloses a dynamic health testing evaluation apparatus which includes a load device such as a treadmill and a computer arrangement to control and program the load provided to the person using the apparatus. Various physiological parameters such as heart rate and rhythm, blood pressure, etc. are mentioned. The load against which the user must work is controlled responsive to one or more of these parameters. This apparatus can be used by a relatively healthy person or by a person with physical handicaps.

Burian et al teaches a monitoring system for measuring pulse rate and comparing it against a predetermined level. Deviations above or below the standard level are indicated by lights.

Putsch discloses an exercise apparatus which measures various physiological parameters, determines the amount of energy expended by the user, and allows for variation of the load according to the energy expended.

None of these prior art arrangements, however, is capable of providing a true training effect, to automatically bring the user to successively higher levels of physical performance.

Accordingly, it is an object of the present invention to provide an improved exercise apparatus and method for providing a true training effect.

As herein described there is provided a method for subjecting an individual to progressive exercise, comprising the steps of: establishing the rate at which work is to be performed against a load having a predetermined initial value; generating a level met signal to indicate when said work has been performed at said established rate; after said level met signal is generated, increasing the value of the rate at which work is to be performed; and thereafter repeating said work rate value setting step each time a level met signal corresponding to the next preceding step is generated.

Also herein described is an adaptive exercise apparatus comprising: a variable load; means for enabling an individual to perform work against said load in repetitive cycles; means for counting said cycles; means for measuring the number of said cycles completed within a desired time interval; means for setting said number of cycles to be performed within said desired time interval and the magnitude of said load at predetermined initial values; and means responsive to the output of said counting means for incrementally (i) increasing the magnitude of said load, (ii) increasing the value of said number of cycles, (iii) decreasing the value of said time interval, when said preset number of cycles is completed within said initial value of said desired time interval, or (iv) increasing the stroke or length associated with the particular exercise being performed.

IN THE DRAWING

The adaptive control apparatus and method of the present invention requires the user to perform successive cycles or repetitions of work against a load the magnitude of which is set (manually or via a predetermined program) to a predetermined initial value. The apparatus then measures the rate at which the work is performed, by measuring the number of cycles or repetitions completed within a desired time interval, which may also be preset (manually or via a predetermined program) to a predetermined initial value. The number of cycles or repetitions to be completed within said time interval may also be preset (manually or via a predetermined program).

Thus the apparatus essentially measures the average power developed by the user during the exercise, i.e., the rate at which work is done.

When the desired performance objective power level is reached, i.e., when the desired number of cycles or repetitions is completed against the initial load within the desired time interval, a "level met " signal is generated. Thereupon the apparatus requires the user to develop greater power by (i) incrementally increasing the magnitude of the load, (ii) incrementally decreasing the desired time interval within which the present number of cycles or repetitions must be performed, (iii) increasing the number of cycles or repetitions to be performed against the same load within the same desired time interval, or (iv) increasing the stroke or length associated with the particular exercise being performed.

When the user generates sufficient power to achieve the next level of performance objective, the performance level is again incrementally increased. This process is repeated until the user achieves a preset maximum level of performance.

If desired, the magnitude of each performance level step can be manually or automatically preset, and various combinations of incremental variation of load magnitude, desired time interval, and number of cycles or repetitions may be employed, depending upon the physical characteristics of the particular individual and the purpose of the exercise.

For training various portions of the body, various loads may be employed, such as sliding or rotational frictional loads, pulley arrangements for lifting weights, and the like.

Figure 1:
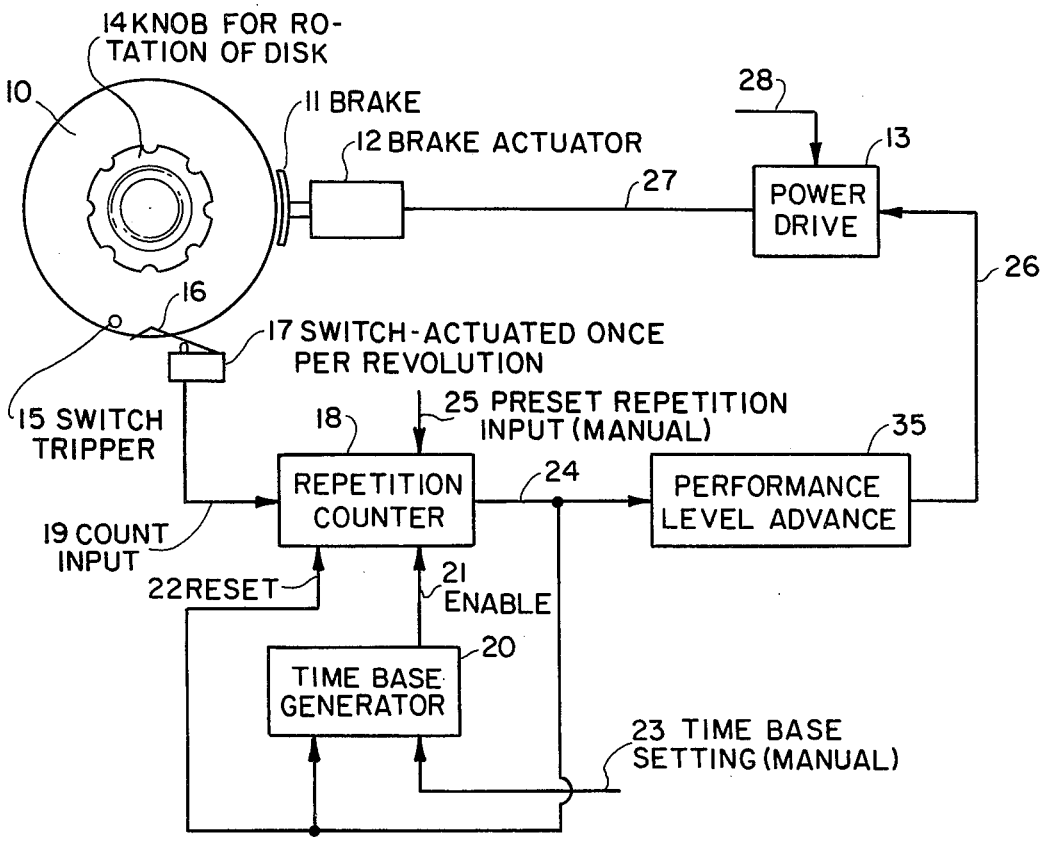
FIG. 1 is a block diagram of an adaptive exercise apparatus according to a preferred embodiment of the present invention.

FIG. 1 illustrates an embodiment of the invention in which a rotational frictional load is provided by the action of a brake disc 10 against a brake pad 11 which is urged against the periphery of the disk 10 by a brake actuator 12 (e.g., a hydraulic cylinder) under control of a power drive circuit 13, which may comprise an electric motor, hydraulic pump, or the like. Alternatively, any other desired form of braking mechanism, such as an electrodynamic brake, hysteresis brake or the like may be employed.

A knob or crank 14 is provided to enable the user to manually rotate the disk 10 against the frictional resistance of the brake pad 11. A switch tripper pin 15 extends from the surface of the disk 10 and trips the actuating lever 16 of a switch 17 once during each cycle of rotation of the disk 10.

A repetition counter 18 receives the count input signal from the switch 17 on line 19, a reset signal from time base generator 20 on line 21, and a reset signal from repetition counter 18 on line 22.

The time interval between the enable and reset signals is set by a time base setting signal (which may be manually or automatically preset) on line 23. The capacity of the repetition counter 18, i.e. the number of count input signals on line 19 corresponding to one count output signal on line 24, is established by a manually or automatically preset repetition input signal on line 25.

The counter output signal on line 24 is coupled to a performance level advance circuit 35 which may comprise a conventional staircase generator or stepping switch. The performance level advance circuit 35 provides an output signal on line 26 which increases in incremental steps in response to the counter output signal on line 24, i.e. increasing by one step each time a signal appears on line 24.

The output of the performance level advance circuit 35 on line 26 is coupled to the power drive circuit 13, which applies a force to the brake actuator 12 and brake pad 11 via connection 27, which is monotonically related to the signal on line 26. The relationship between the size of the step increments of the signal on line 26, and the force applied to the brake pad 11, i.e. the increase in load, may be proportional or logarithmic (or have any other desired rate of change characteristic), depending upon the objectives of the exercise involved. Each load level may have any desired value, greater or less than and independent of the values of the other levels.

In utilizing the apparatus of FIG. 1, the user or his supervisor establishes initial settings for the frictional load which the user is to overcome when turning the knob 14 (via the bias control line 28), the capacity of the counter 18 (via the signal on line 25), and the desired time interval within which the preset number of repetitions is to be performed against the initially established load (via the signal on line 23).

Thereafter the user proceeds to rotate the knob 4 against the frictional resistance between the brake pad 11 and disk 10. The user does this work at any rate he chooses and for as long or short a period of time as he chooses. However, the apparatus will not respond until the level of performance objective set by the signals on lines 25, 28 and 23 has been met, i.e. the desired number of repetitions has been completed against the initial load within the desired time interval.

When this initial performance objective, i.e. average level of power generated or rate at which work is performed, has been met, a counter output signal or "level met" signal is generated on line 24 and coupled to the performance level advance circuit 35. This signal is generated only when the aforementioned number of repetitions is achieved within the time period between occurrence of the enable and reset signals on lines 21 and 22, since a slower rate of work will result in resetting of the counter 18 before it can reach its full count capacity.

The performance level advance circuit 35 then increases the value of the output signal on line 26 thereof, causing the power drive circuit 13 to incrementally increase the load applied to the disk 10 by the brake pad 11.

The user then attempts to perform the same number of repetitions within the same time interval against the increased load, i.e. to achieve the next highest power level of performance objective. When this next highest level of performance objective is met, a counter output signal again appears on line 24, and the process is repeated, to cause the user to "graduate" to successively higher levels of performance objective.

Alternatively, successive levels of performance objective may be set by (i) reducing the time interval within which the work is to be done, (ii) increase the number of repetitions to be performed within the same time interval, (iii) increasing the stroke or length associated with the particular exercise being performed.

It is thus evident that this apparatus trains the user according to his achieved level of performance, and requires the user to achieve successively greater power output levels, while permitting the user to remain as long as desired at each level.

Figure 2:
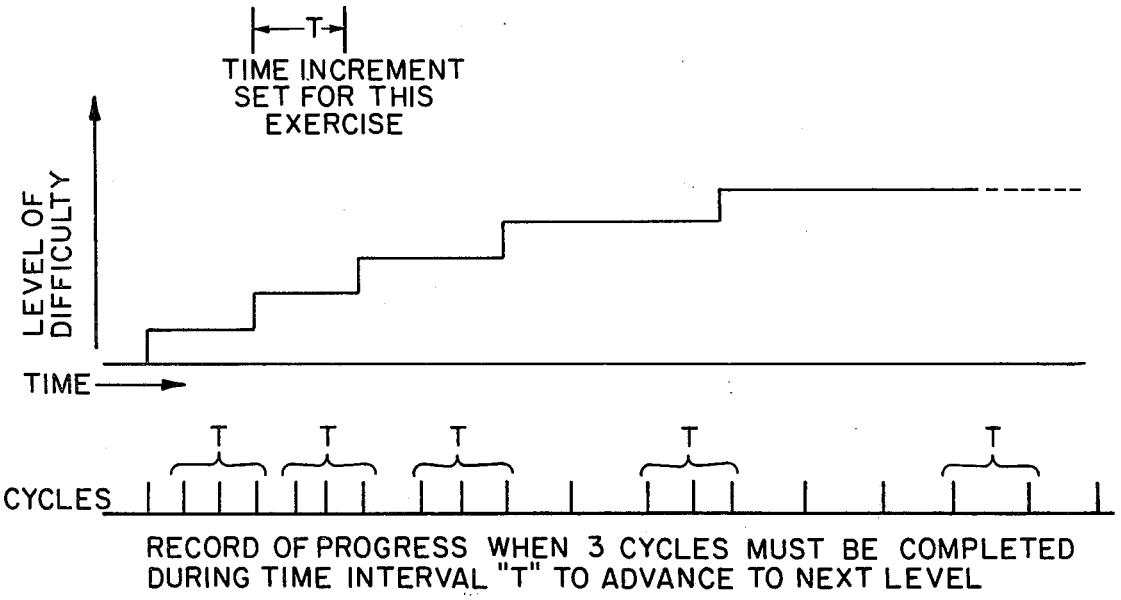
FIG. 2 is a diagram illustrating the operation of the apparatus of FIG. 1.

This training or "staircase" operation of the apparatus according to the invention is illustrated in FIG. 2, which shows the relationship between successive levels of accomplishment and succeeding generated levels of performance objective, both measured in terms of the average rate of work done by the user or the average power generated, said terms being equivalent.

Figures 3, 4:
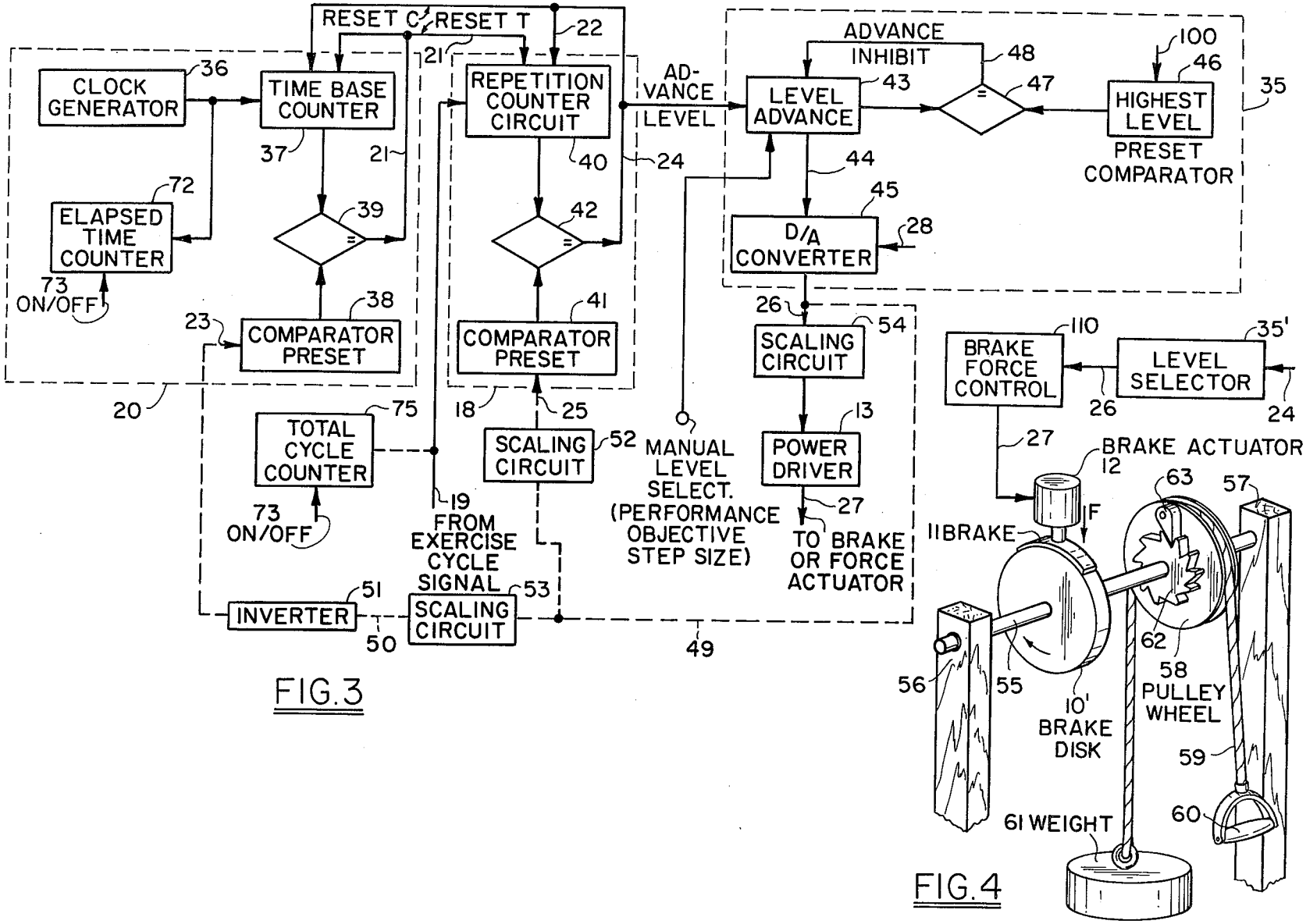
FIG. 3 is a more detailed functional block diagram of a portion of the apparatus shown in FIG. 1.
FIG. 4 is a mechanical/electrical diagram showing a portion of an alternative embodiment of the invention.
Figure 5:
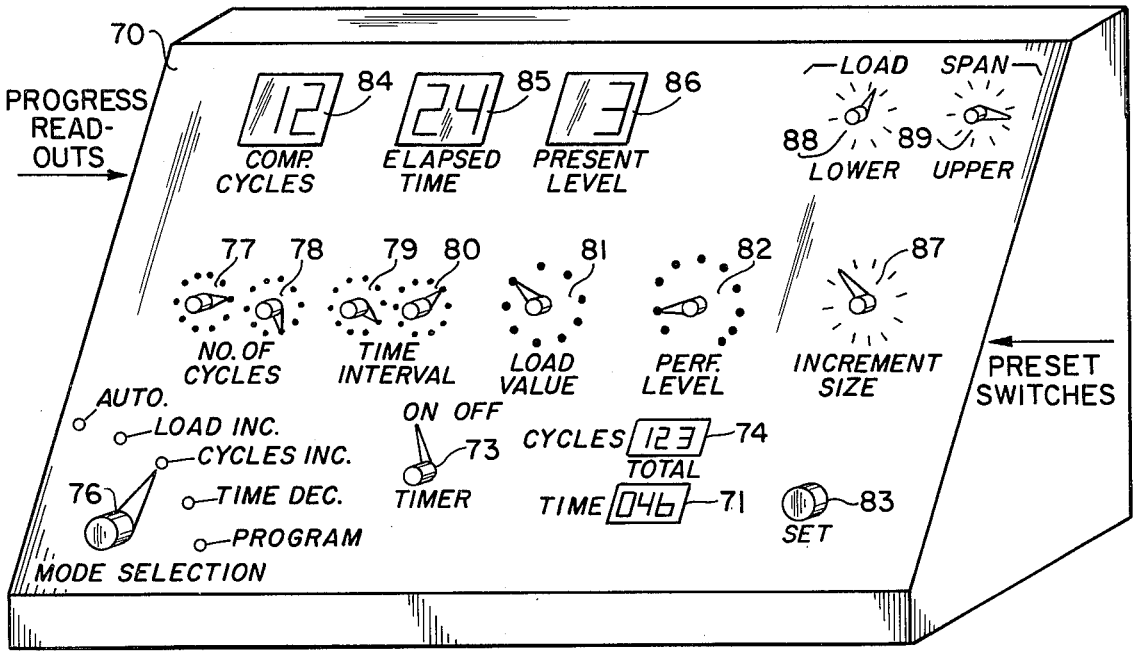
FIG. 5 shows the display/control panel of the apparatus of FIGS. 1 and 3.

The control panel of the electrical portion of the apparatus shown in FIG. 1, is illustrated in FIG. 5. The face of the control panel 70 includes a digital readout 71 of elapsed time, from the elapsed time counter 72 (FIG. 3), in response to the timer on-off control 73. Similarly the total number of exercise cycles completed during the interval defined by the operation of the switch 73, is shown on a digital readout 74 coupled to the total cycle counter 75 (FIG. 3).

In the manual modes, i.e., load increase, cycles increase or time decrease, the size of each increment of load, number of cycles, or time is determined by the setting of the increment size selector switch 87.

The mode selection switch 76 has an "auto" position, in which the load values, number of exercise cycles per performance level, and time within which the cycles are to be completed, is established by a program recorded in a computer, on a magnetic medium, or otherwise. In the "load increase" mode as set by the switch 76, successive levels of performance objective are established by increasing the load when the previously established level has been met. The "cycles increase" mode establishes successive performance levels by increasing the number of repetitions of the exercise to be completed within the preset time interval, while the "time decrease" mode decreases the time within which the preset number of cycles is to be completed.

In any mode, the distance range within which the user is to move the load, i.e., linear distance in feet, rotational distance in degrees, etc., may be determined by the upper and lower load span setting switches 88 and 89.

Figure 6:
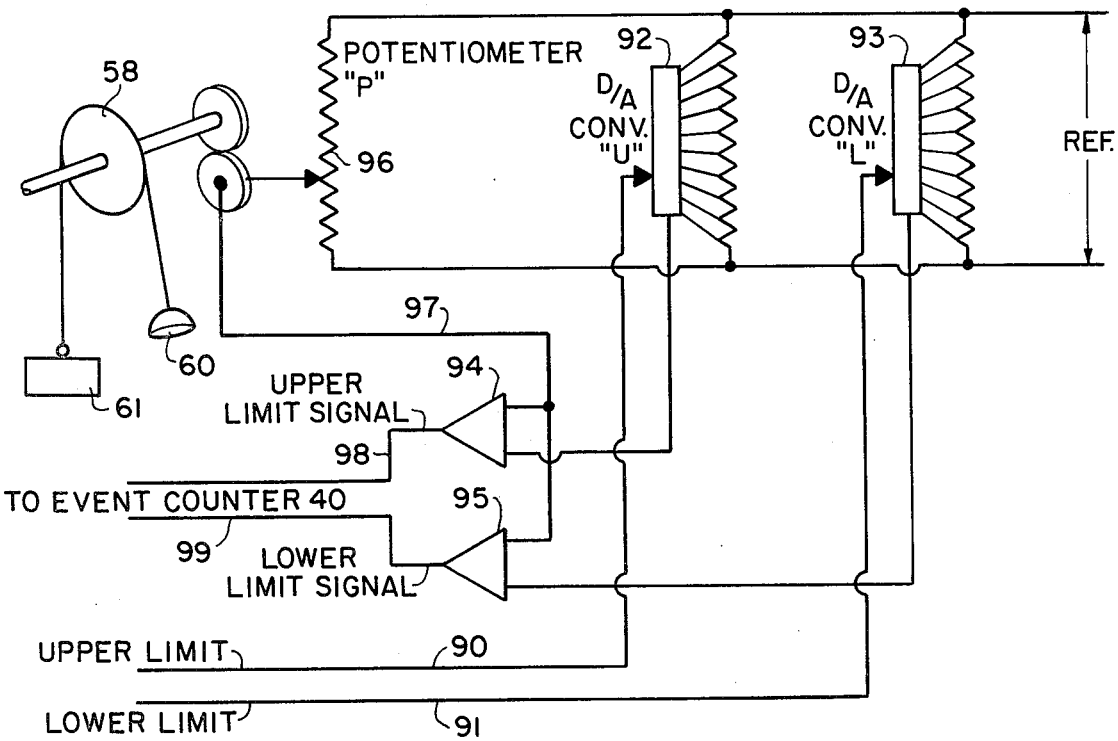
FIG. 6 shows an exercise stroke or linear increment determination arrangement in accordance with still another embodiment of the invention.

As best shown in FIG. 6, the corresponding upper and lower limit signals on lines 90 and 91 are coupled through digital to analog converters 92 and 93 respectively, to respective differential amplifier comparators 94 and 95. The actual position of the load is sensed by a potentiometer 96 and coupled to the differential comparators 94 and 95 on line 97. The comparator 94 generates an upper limit signal on line 98 when the travel of the load 61 exceeds a predetermined value as set by the swtich 89; and the lower limit differential comparator 95 generates a lower limit signal on line 99 when the position of the load 61 is less than that corresponding to the lower limit signal on line 91.

The corresponding upper and lower limit signals on lines 98 and 99 are coupled to the event counter 40 (which contains a bistable circuit to provide one count for each traversal between the upper and lower limits of the load 61 as set by the switches 88 and 89).

The number of cycles to be completed, the time within which they are to be completed, and the corresponding load value are manually set for each level, if so desired, or alternatively preprogrammed by means of the cycles switches 77/78, the time interval switches 79/80, the load switch 81, the lower and upper limit switches 88 and 89, the performance level set switch 82, and the set push button 83.

To preprogram the unit, the mode selector switch 76 is set to the "program" position, the performance level switch 82 is set at level 1 and the number of cycles, time interval and load value switches 77/78, 79/80 and 81 are set to the values which are to correspond to the first performance objective level. After the switches have been set, the set push button 83 is depressed to store these values in a random access memory, on a magnetic medium, etc. The performance level switch 82 is then moved to level 2, and corresponding values are set and stored. This process is repeated until performance objective parameters or all desired levels to be achieved have been set.

The mode selector switch 76 is then placed in the "auto" position to run the program, and the user proceeds to perform the preset exercise parameters, with the number of cycles completed and the elapsed time for each performance level, or for each attempt at said level, shown by the digital readouts 84 and 85 respectively, the readout 86 showing the current level of performance objective.

If desired, the progress (or lack thereof) of the user of the exercise apparatus may be permanently recorded on a magnetic tape, strip chart, or the like, by recording the aforementioned parameters as a function of real time.

Since the output of the apparatus described above includes an electrical signal which represents varying (or constant) values of load, number of repetitions and performance time, these signals may if desired be coupled to a variety of pieces of exercise equipment, for providing progressive exercise (with training effect) for a variety of muscles of various individuals.

The electrical signals can be used to control any type of electromagnetic or hydraulic load actuators, torque motors which can vary tension, and selectively controlled arrangements for engaging various weights by means of solenoids or the like.

FIG. 3 shows a more detailed functional block diagram of the electrical portion of the apparatus shown in FIG. 1, wherein the time base generator 20 is seen to comprise a clock generator 36, a time base counter 37 coupled thereto, a comparator preset circuit 38 for providing a signal corresponding to a desired output of the time base counter 37, and a comparator circuit 39 for generating the time reset signal on line 21 when the counter 37 reaches the value preset by the comparator preset circuit 38 corresponding to a desired time interval.

This signal on line 21 resets the counter 37 of time base generator 20 to start new timing interval, and resets the repetition counter circuit 40 of the repetition counter unit 18 to begin counting exercise cycles from the switch 17 on line 19. A comparator preset circuit 41 generates a signal level determined by the signal on line 25, corresponding to the desired number of repetitions to be performed within the time interval established by the comparator preset circuit 38. A comparator 42 generates the counter output signal on line 24 when the desired number of cycles of exercise has been completed.

The counter reset signal on line 24 is coupled as an input through the level advance counter 43, the output of which is coupled on line 44 to a digital to analog converter 45. The output of the converter 45 is coupled on line 26 to the power driver 13. Therefore, in response to successive signals applied to the level advance counter 43 on line 24, the output of the digital to analog converter 45 on line 26 develops a "staircase" waveform as desired. In addition to advancing level counter 43, the counter reset signal on line 24 performs same functions as time reset signal on line 21.

Another preset comparator circuit 46 responds to a signal on line 100 corresponding to the highest performance objective level to be reached, and the output of a comparator 47 on line 48 inhibits the level advance counter 43 from increasing its count any further, when the highest performance level objective is reached.

As shown by the dashed line 49, the output of the converter 45 on line 26 may alternatively (or also) be coupled back to line 25, to incrementally increase the number of repetitions to be performed at the next performance objective level.

If desired, as shown by the dashed line 50, the "staircase" signal on line 26 may alternatively (or also) be coupled through inverter 51 to signal line 23, to incrementally decrease the time period within which a preset number of exercise cycles is to be completed.

If desired, scaling circuits 52, 53 and 54 may be provided to generate successive levels of performance objective having any desired combination of time interval, number of repetitions and load magnitude.

FIG. 4 shows a slightly different working arrangement, in which the brake disk 10' is affixed to an axle 55 which is rotatably mounted in vertical supports 56 and 57. A pulley wheel 58 is affixed to the axle 55 laterally of the disk 10', and has a peripheral groove within which a portion of the rope 59 is disposed. A handle 60 is provided for the user, who performs work against a weight 61, by rotating the pulley wheel 58, and against the frictional force between the brake pad 11 and brake disk 10.

A ratchet wheel 62 secured to the pulley wheel 58 engages a pawl 63 for preventing injury by preventing the weight 61 from rapidly rotating the pulley wheel 58 against the force exerted by the user via the handle 60.

This arrangement simulates weight changes without subjecting the user to the return force, which remains minimal. Only the force opposing pull is varied. The only purpose of the weight 61 in this arrangement is to maintain the rope or cable 59 taut, and not to apply any significant amount of force opposing the force applied by the user. If desired, instead of the weight 61, a torque motor or similar device may be employed.

What is claimed is:

1. An adaptive method for subjecting an individual to progressive exercise, comprising the steps of:

establishing the number of repetitions of an exercise to be performed against a resistance means in a desired time interval;

setting the magnitude of said resistance means and the length of said desired time interval at predetermined initial values;

sensing performance by said individual;

generating a level met signal as a function of sensed performance to indicate a first level of accomplishment if and when said established number of repetitions is performed within said desired time interval;

setting a higher level performance objective responsive to said level met signal by incrementally increasing the magnitude of said resistance means to a predetermined value greater than said initial value; and thereafter repeating said level met signal generating and resistance means magnitude increasing steps to indicate and set successively higher levels of accomplishment and performance objectives respectively.

2. An adaptive method for subjecting an individual to progressive exercise, comprising the steps of:

establishing the number of repetitions of an exercise to be performed against a resistance means in a desired time interval;

setting the magnitude of said resistance means and the length of said desired time interval at predetermined initial values;

sensing performance by said individual;

generating a level met signal as a function of sensed performance to indicate a first level of accomplishment if and when said established number of repetitions is performed within said desired time interval;

setting a higher level performance objective responsive to said level met signal by incrementally decreasing said desired time interval to a value less than the initial value thereof; and thereafter repeating said level met signal generating and desired time interval decreasing steps to indicate and set successively higher levels of accomplishment and performance objectives respectively.

3. A method for subjecting an individual to progressive exercise, comprising the steps of:

establishing the rate at which work is to be performed against a resistance means having a predetermined initial value;

sensing performance by said individual;

generating a level met signal as a function of sensed performance to indicate when said work has been performed at said established rate;

increasing the value of the rate at which work is to be performed responsive to said level met signal; and thereafer repeating said work rate value setting step each time a level met signal corresponding to the next preceding step is generated.

4. The method according to claim 3, wherein said work rate is increased by increasing said resistance means.

5. The method according to claim 3, wherein said work rate is increased by decreasing a preset time interval in which the work is to be performed.

6. The method according to claim 3, wherein said work rate is increased by increasing the number of repetitions of an exercise to be performed against said resistance means within a preset time interval.

7. A method for subjecting an individual to progressive exercise, comprising the steps of:

establishing the desired number of repetitions of an exercise to be performed against a resistance means in a given time interval;

setting the magnitude of said resistance means and the length of said given time interval at predetermined initial values;

sensing performance by said individual;

generating a level met signal as a function of sensed performance to indicate a first level of accomplishment when said desired number of repetitions is performed within said given time interval;

setting a higher level performance objective responsive to said level met signal by incrementally increasing said desired number of repetitions to a value greater than the initial value thereof; and thereafter repeating said level met signal generating and desired number of repetitions increasing steps to indicate and set successively higher levels of accomplishment and performance objectives respectively.

8. Adaptive exercise apparatus, comprising:

a variable resistance means;

means for enabling an individual to perform work against said resistance means in repetitive cycles;

means for setting said number of cycles to be performed within said desired time interval and the magnitude of said resistance means at predetermined initial values;

means for counting said cycles;

means for measuring the number of said cycles completed by said individual within a desired time interval; and means responsive to the output of said counting means for incrementally increasing the magnitude of said resistance means if and when said preset number of cycles is completed within said initial value of said desired time interval.

9. Adaptive exercise apparatus, comprising:

a variable resistance means;

means for enabling an individual to perform work against said resistance means in repetitive cycles;

means for setting said number of cycles to be performed within said desired time interval and the magnitude of said load at predetermined initial values;

means for counting said cycles;

means for measuring the number of said cycles completed by said individual within a desire time interval; and means responsive to the output of said counting means for incrementally decreasing the value of said desired time interval if and when said preset number of cycles is completed within said initial value of said desired time interval.

10. Adaptive exercise apparatus, comprising:

a resistance means movable along a given path to traverse upper and lower limits of movement;

means for enabling an individual to perform work by moving said resistance means along said path in repetitive cycles;

means for counting said cycles;

means for setting the upper and lower limits to be traversed by said resistance means along said path; and means responsive to the output of said counting means for incrementally increasing the distance between said upper and lower limits when the number of cycles completed along said path between the initial values thereof reaches a desired value.

11. The apparatus according to claim 10, wherein said path is circular.

12. The apparatus according to claim 10, wherein said path is rectilinear.

13. The apparatus according to claim 8, 9 or 10, wherein said resistance means comprises grasping means, first means for generating a force on said grasping means in one direction and for resisting movement of said grasping means in the opposite direction, second means for simultaneously resisting movement of said grasping means in the opposite direction, and unidirectional coupling means for disengaging said second means from said grasping means upon movement of said grasping means in said one direction.

* * * * *

UNITED STATES PATENT AND TRADEMARK OFFICE

CERTIFICATE OF CORRECTION

PATENT NO. : 4,323,237

DATED : April 6, 1982

INVENTOR(S) : Bernard R. Jungerwirth

It is certified that error appears in the above—identified patent and that said Letters Patent is hereby corrected as shown below:

COlumn 3, line 66: "Knob 4" should be --knob 14--.

Signed and Sealed this

*Twenty-first* Day of *December 1982*

[SEAL]

*Attest:*

GERALD J. MOSSINGHOFF

*Attesting Officer*

*Commissioner of Patents and Trademarks*